US010748461B2

(12) United States Patent
Fenimore et al.

(10) Patent No.: US 10,748,461 B2
(45) Date of Patent: Aug. 18, 2020

(54) VEHICLE CURB AND ADVERTISEMENT SYSTEM

(71) Applicant: Mascot Marketing, Inc., Bradenton, FL (US)

(72) Inventors: J. Scott Fenimore, Tierra Verde, FL (US); Matthew Stutsman, Carson City, NV (US)

(73) Assignee: Mascot Marketing, Inc., Tampa, FL (US)

( * ) Notice: Subject to any disclaimer, the term of this patent is extended or adjusted under 35 U.S.C. 154(b) by 0 days.

(21) Appl. No.: 16/161,568

(22) Filed: Oct. 16, 2018

(65) Prior Publication Data

US 2019/0139467 A1 May 9, 2019

Related U.S. Application Data

(60) Provisional application No. 62/582,443, filed on Nov. 7, 2017.

(51) Int. Cl.

| | |
|---|---|
| ***E01F 9/00*** | (2016.01) |
| ***G09F 19/22*** | (2006.01) |
| ***E01F 9/541*** | (2016.01) |
| ***E01C 11/22*** | (2006.01) |

(52) U.S. Cl.

CPC ..... *G09F 19/228* (2013.01); *E01C 11/222* (2013.01); *E01F 9/541* (2016.02)

(58) Field of Classification Search

CPC .... E01C 11/221; E01C 11/222; E01C 11/223; E01F 15/025; E01F 15/0446; E01F 9/541; G09F 19/228

See application file for complete search history.

(56) References Cited

U.S. PATENT DOCUMENTS

| | | | | |
|---|---|---|---|---|
| 1,994,027 A * | 3/1935 | Poston | E01F 9/602 | 404/11 |
| 5,515,807 A * | 5/1996 | Speer | E01F 9/535 | 116/63 R |
| D418,167 S * | 12/1999 | Stutsman | D20/10 | |
| 6,692,182 B1 * | 2/2004 | Fenimore | E01F 15/083 | 404/7 |
| 7,351,003 B1 * | 4/2008 | Fenimore | E01F 15/085 | 40/565 |

(Continued)

*Primary Examiner* — Cassandra Davis

(74) *Attorney, Agent, or Firm* — GrayRobinson, P.A.

(57) ABSTRACT

A vehicle curb with advertising system including a bottom panel that is connected to a lower curved panel which is then connected to an upper curved panel. These panels distribute axial and translational forces, imparted by the vehicle's tires, by taking advantage of corrugation and curved designs. Further, the upper curved panel is connected to an upper retaining lip, which is then connected to a front concave panel, which is then connected to a lower front retaining lip. The two retaining lips contact the vehicle's tires and together with the concave panel, distribute the externally applied forces throughout the system. Further, the two front retaining lips provide an attaching means for a user to attach a logo or advertisement to the system. The system also has pads connected to the bottom panel that resist the externally applied forces by "gripping" the underlying floor, thus effectively stopping the vehicle without slippage.

3 Claims, 8 Drawing Sheets

(56) References Cited

U.S. PATENT DOCUMENTS

2009/0195002 A1* 8/2009 Meyers ..... E01F 15/003
293/122
2015/0144436 A1* 5/2015 Bonk ..... B64F 1/16
188/32

* cited by examiner

VEHICLE CURB AND ADVERTISEMENT SYSTEM

CROSS-REFERENCE TO RELATED APPLICATIONS

This application claims priority to pending provisional application No. 62/582,443, filed Nov. 7, 2017, the disclosure of which is hereby incorporated by reference herein.

BACKGROUND OF THE INVENTION

Field of the Invention

This invention relates to parking curbs for use in garages and the like, as well as placeholders for images such as logos.

Description of the Background Art

Presently, parking curb systems, such as ones used for indoor garages, are used to delimit a vehicle's forward or reverse movements. Many of these parking curbs must be mechanically fastened to the underlying material, such as screwing the curb onto the underlying floor or using an adhesive to fasten the curb onto the underlying floor or by simply using heavy curbs without the need for fastening. Parking curbs that do not require fastening to the underlying floor, tend to move when a translational force is applied because the curbs are not suited to "latch" onto the floor without further attaching means. Also, when axial forces are applied to these curbs, the curbs may structurally crumble.

Therefore, it is an object of this invention to provide an improvement which overcomes the aforementioned inadequacies of the prior art devices and provides an improvement which is a significant contribution to the advancement of the parking curb art.

Another object of this invention is to provide a parking curb system that delimits the movement of a vehicle.

Another object of this invention is to provide a parking curb system suitable to advertise or display a user's choice of logos, advertisements, etc.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a parking curb with advertisement system used to delimit a user's vehicle while having the ability to effectively display or advertise that user's advertisements, logos, etc.

Embodiments of the present invention are herein described by way of example and directed to a parking curb structure with accompanying advertising abilities. The aforementioned state of the art of parking curbs shows the need for improvements, specifically in the ability of the parking curb to be relatively light weight yet sturdy, non-invasive, and readily removable by the average consumer.

The vehicle curb with advertising system of the present invention satisfies the aforementioned deficiencies because of its unique design and ability to properly distribute externally applied forces. The system includes a bottom panel that is connected to a lower concave panel which is then connected to an upper curved panel. These panels distribute axial and translational forces by taking advantage of corrugation and concave/curved designs. Further, the upper curved panel is connected to an upper retaining lip, which is then connected to a front concave panel, which is then connected to a lower front retaining lip. The two retaining lips contact the vehicle's tires and together with the concave panel, distribute the externally applied forces throughout the system. These two front retaining lips also allow a user to attach an advertisement or logo to the curb system.

Further, the vehicle curb with advertising system is manufactured to be larger or smaller, depending on the desire of the user. For instance, lower profile vehicles, such as high-end sports vehicles, would sit closer to the ground, thus requiring the vehicle curb with advertising system to be smaller in overall shape to account for the lower front or rear bump of the vehicle.

The system has pads connected to the bottom panel that resist the externally applied forces by "gripping" the underlying floor.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
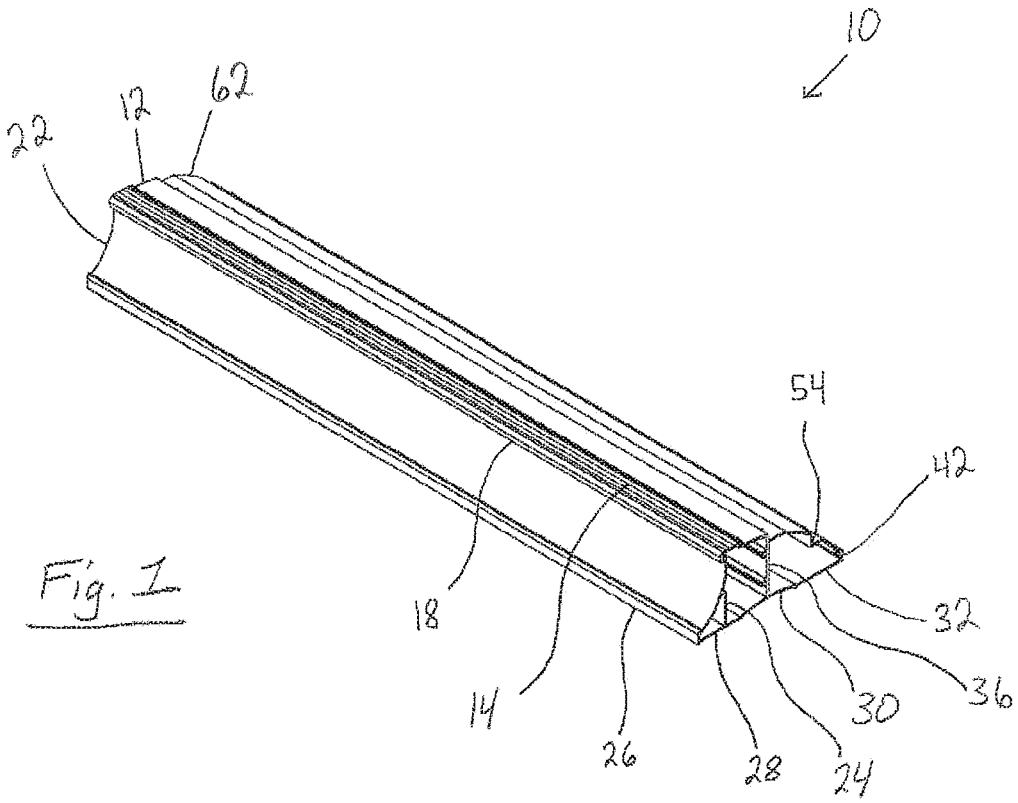
FIG. 1 is a front perspective view of the vehicle curb with advertising system in accordance with the underlying principles of the present invention.
Figure 2:
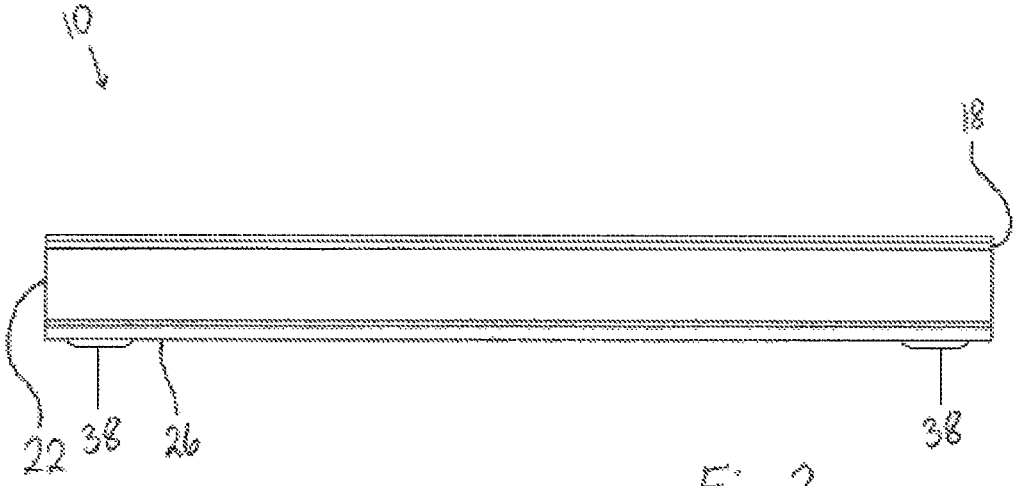
FIG. 2 is a front elevational view thereof.
Figure 3:
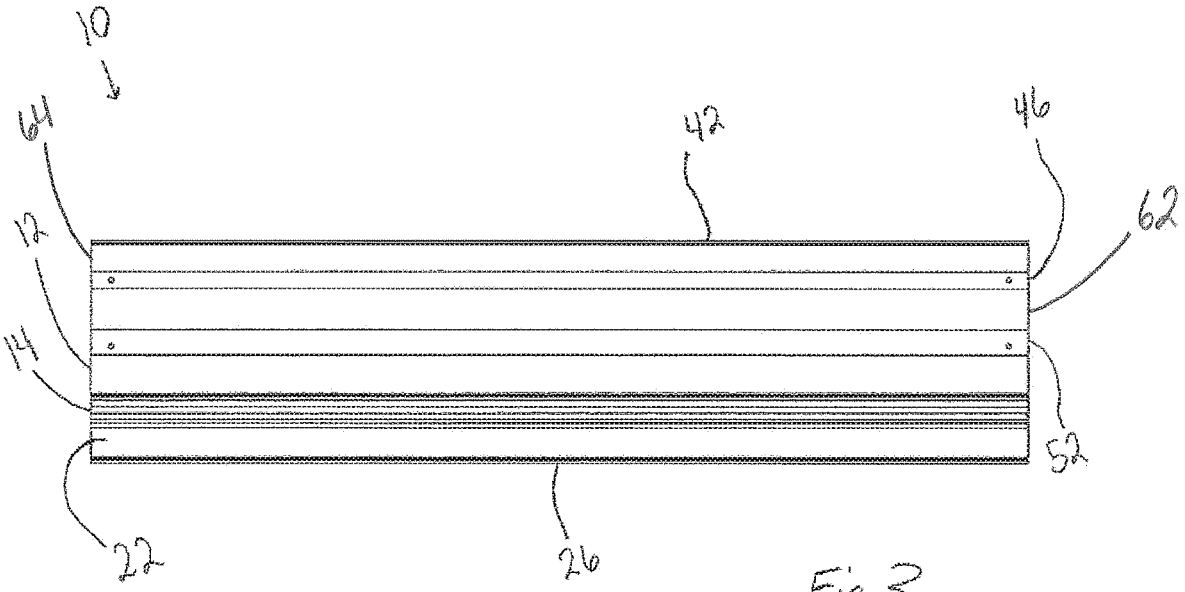
FIG. 3 is a top elevational view thereof.
Figure 4:
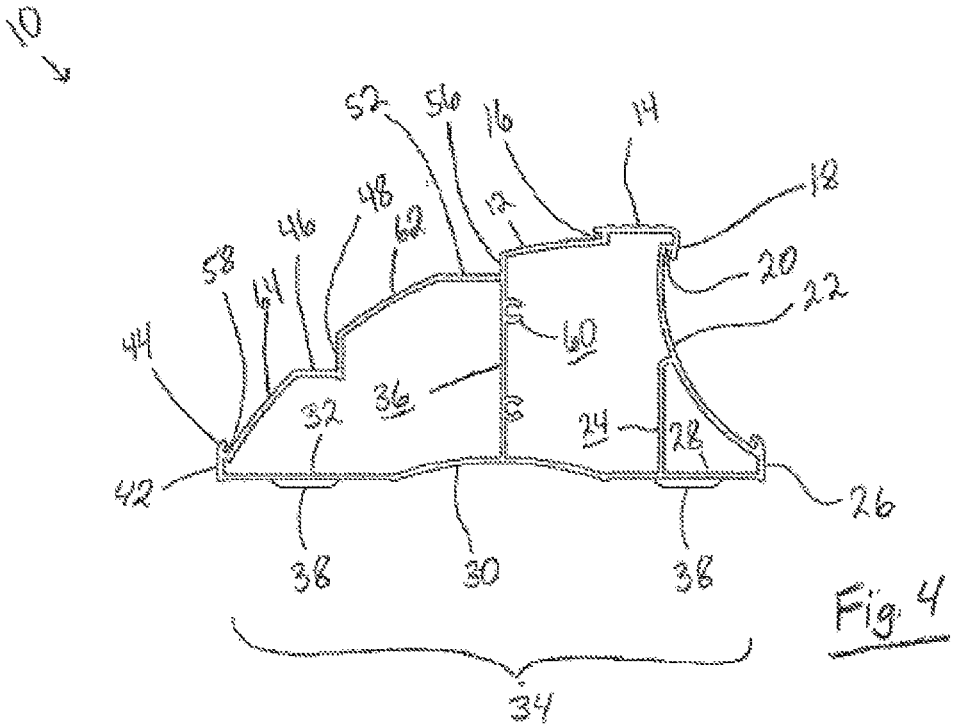
FIG. 4 is a left elevational view thereof.
Figure 5:
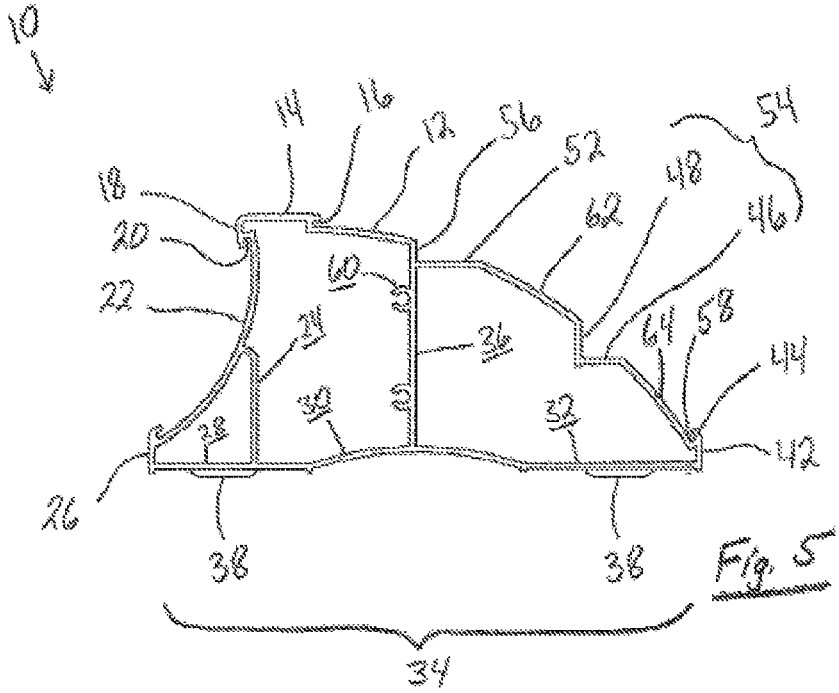
FIG. 5 is a right elevational view thereof.
Figure 6:
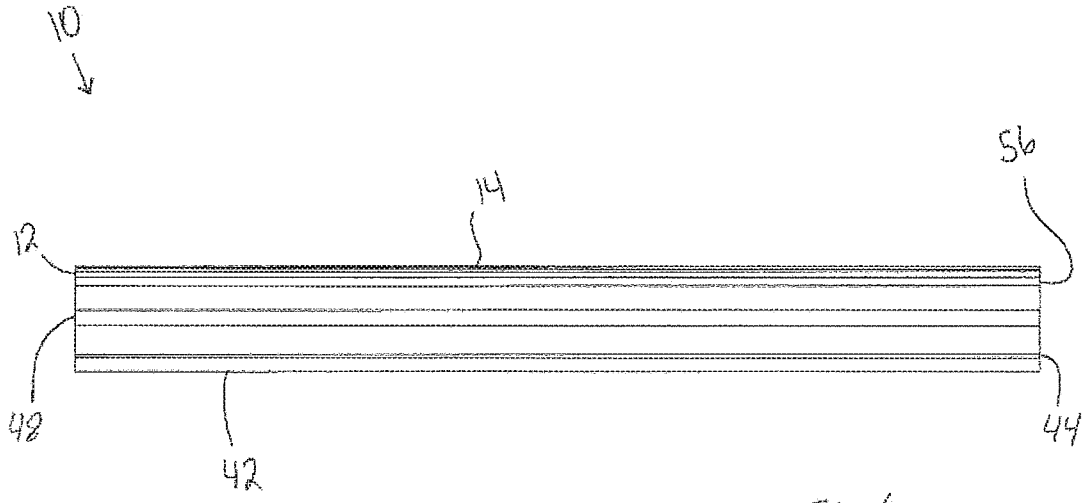
FIG. 6 is a rear elevational view thereof.
Figure 7:
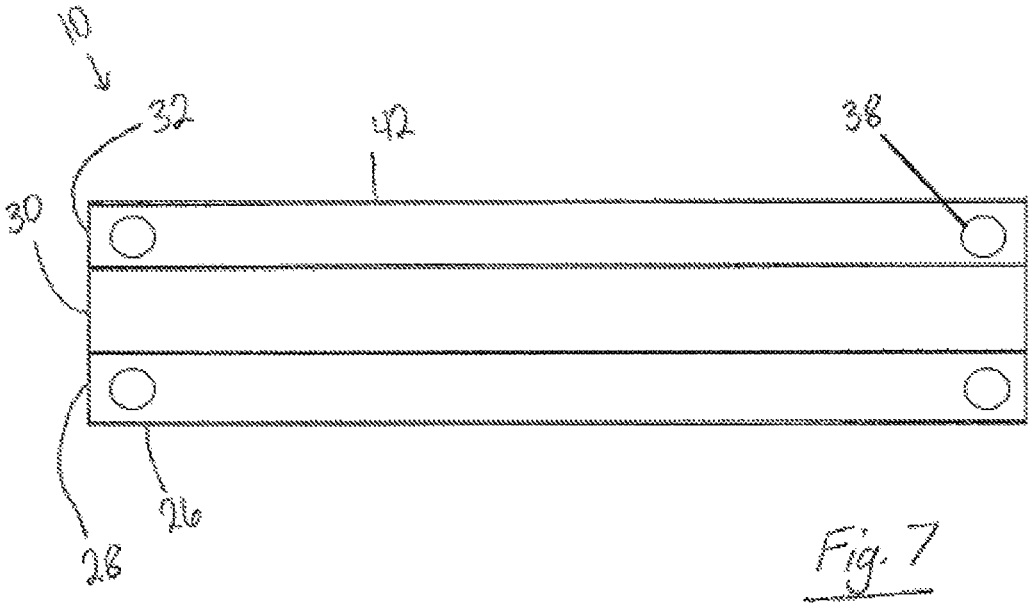
FIG. 7 is a bottom elevational view thereof.

Referring to FIGS. 1-7, a vehicle curb with advertising system 10 comprises a bottom panel 34 (shown in FIGS. 4 and 5) having a concave portion 30 relatively between a lower front retaining lip 26 and a lower rear retaining lip 42. The bottom panel 34 comprises a front portion 28 and a rear portion 32. The widths of the front 28 and rear portions 32 vary with the location of the concave portion 30. The rear portion 32 of the bottom panel 34 is attached to the lower rear retaining lip 42, which has an angled portion 44. In one embodiment of the present invention, the concave portion 30 of the bottom panel 34 is placed at a distance closer to the lower rear retaining lip 42 or alternatively, it is placed at a distance closer to the lower front retaining lip 26. Preferably, the concave portion 30 is placed at a location relatively central in relation to the lower rear retaining lip 42 and the lower front retaining lip 26. Furthermore, depending on the externally applied forces, additional concave portions 30 is included in the bottom panel 34.

A lower longitudinal curved panel 64 is attached to the lower rear retaining lip 42 or alternatively, to the angled portion 44 of the lower rear retaining lip 42 or the middle longitudinal curved panel 62. Further, it is attached to the rear portion 32 of the bottom panel 34 or alternatively, to a lower rear connecting protrusion 58. The lower rear connecting protrusion 58 protrudes from the lower retaining lip 42 or its angled portion 44. The lower longitudinal curved panel 64 comprises a longitudinal strengthening groove 54 and is attached to an upper vertical part 56. In one embodiment, an upper horizontal part 52 of the lower longitudinal curved panel 64 is attached to the upper vertical part 56 or alternatively, to an upper longitudinal curved panel 12.

Preferably, the lower longitudinal curved panel 64 has at least one longitudinal strengthening groove 54 placed at uniform locations along its length or width. Alternatively, the lower longitudinal curved panel 64 has a plurality of the longitudinal strengthening grooves 54 placed at non-uniform locations throughout its length or width. The longitudinal strengthening groove 54 comprises a lower horizontal part 46 and a lower vertical part 48. The lower longitudinal curved panel 64 is further connected to a middle longitudinal curved panel 62.

The middle longitudinal curved panel 62 is connected to the lower vertical part 48 or to the upper horizontal part 52.

The upper longitudinal curved panel 12 is attached to the upper vertical part 56 or alternatively, to the upper horizontal part 52 of the lower longitudinal curved panel 64. Further, it is attached to an upper rear connecting protrusion 16 or alternatively to an upper rear retaining lip 14. The upper rear retaining lip 14 is attached to the upper longitudinal curved panel 12 by way of the upper rear connecting protrusion 16 or alternatively, without the inclusion of the upper rear connecting protrusion 16. The upper rear retaining lip 14 is attached to the upper front retaining lip 18 thereby forming an angle, which is either acute or obtuse.

Notably, the upper longitudinal curved panel 12, upper vertical part 56, upper horizontal part 52, middle longitudinal curved panel 62, lower vertical part 48, lower horizontal part 46 and lower longitudinal curved panel 64 compose a curved member 66. The curved member 66 preferably has an overall curved geometry; however, in one embodiment, it is composed of linear parts to form a curved shape. That is, the lower longitudinal curved panel 64, middle longitudinal curved panel 62 and the upper longitudinal curved panel 12 are configured to have a linear cross section, while in concert has an overall curved geometry.

The upper front retaining lip 18 is attached to a front concave panel 22 by way of an upper front connecting protrusion 20. Preferably, the front concave panel 22 is uniformly concave or alternatively, it has a plurality of indentations or protrusions along its surface to more appropriately distribute applied forces. The front concave panel 22 is attached to the lower front retaining lip 26, which is attached to the front portion 28 of the bottom panel 34. Alternatively, the front concave panel 22 is attached to the front portion 28 of the bottom panel 34 without the inclusion of the lower front retaining lip 26.

A user is able to attach advertisement or logo to the front concave panel 22 by inserting the advertisement or logo in between the upper front retaining lip 18 and the lower front retaining lip 26.

A front vertical wall 24 is attached to the front concave panel 22 and the front portion 28 of the bottom panel 34. A rear vertical wall 36 is attached to the upper vertical part 56 or alternatively, to the upper longitudinal curved panel 12 or the upper horizontal part 52. The rear vertical wall 36 has a plurality of longitudinal connecting means 60 by which segments of the vehicle curb with advertising system 10 attaches, thereby increasing the length of the vehicle curb with advertising system 10.

In one embodiment, the rear vertical wall 36 has a relatively corrugated, non-symmetric, or non-uniform design. Preferably, the rear vertical wall 36 has a uniform design. The rear vertical wall 36 is attached to the concave portion 30 of the bottom panel 34 or alternatively, to the front 28 or rear portions 32 of the bottom panel 34.

In one embodiment, the front vertical wall 24 has a relatively corrugated, non-symmetric, or non-uniform design. Preferably, the front vertical wall 24 has a uniform design. The front vertical wall 24 is attached to the front portion 28 of the bottom panel 34 or if necessary, to the additional concave portions 30 of the bottom panel 34.

The bottom panel 34 further comprises a plurality of pads 38. The pads 38 are attached by means of connecting voids 40 placed at non-uniform locations throughout the bottom panel 34. Preferably, the pads 38 are connected relatively near a perimeter location of the bottom panel 34.

Figure 8:
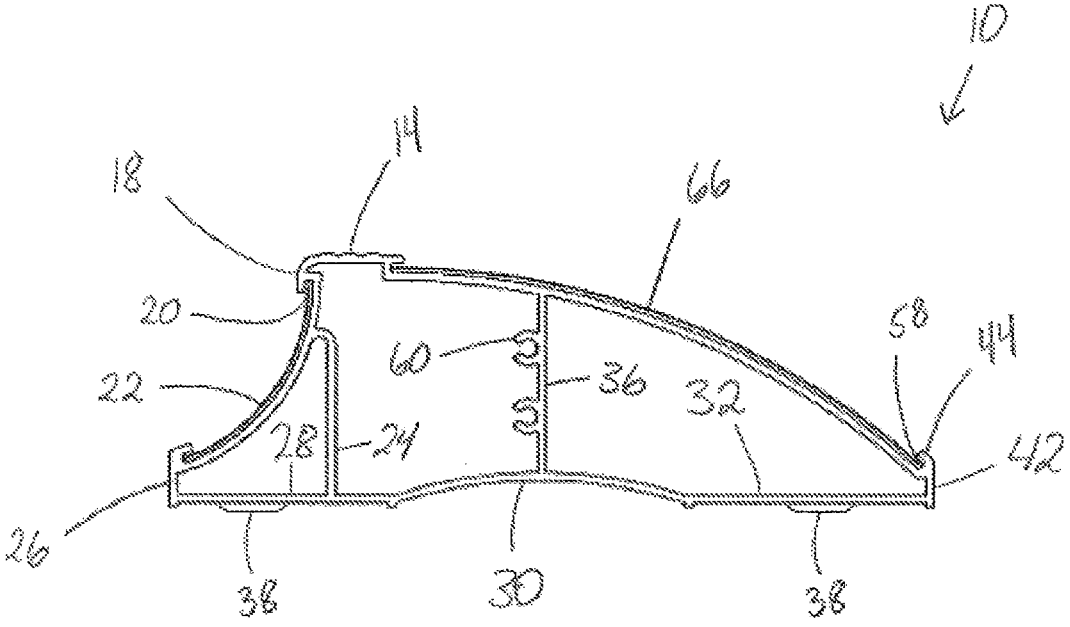
FIG. 8 is a right elevational view of the second embodiment thereof.

As shown in FIG. 8, a second embodiment of the present invention includes a curved member without corrugation. The curved member of FIG. 8 is without corrugation for the purpose of having a different strain characteristic. In contrast to the corrugation in FIGS. 1-7, the folding or bending of the embodiment in FIG. 8 will likely occur after the invention has been moved translationally. This is ideal for a user that mistakenly contacts the invention with too much forward momentum and/or for a user with a low profile vehicle such as a sports car. Notably, the second embodiment in FIG. 8, as well as the first embodiment in FIGS. 1-7, are manufactured with dimensions dictated by the user's needs. Thus, the invention has varying dimensions, ranging from small to large.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A vehicle curb advertisement apparatus, comprising in combination:

at least one front portion and at least one rear portion, said at least one front portion and at least one rear portion extending parallel to one another, both said rear portion and said front portion connected to a concave portion extending along said front and rear portions;

a lower front retaining lip, a lower rear retaining lip and an upper front retaining lip, wherein the lower front retaining lip and the lower rear retaining lip each extending along respective said front and rear portions;

a member connected to said lower rear retaining lip and an upper rear retaining lip;

a front concave panel connected to said lower front retaining lip and said upper front retaining lip;

at least one rear vertical wall having an upper end and a lower end and extending along said concave portion, wherein said rear vertical wall upper end is connected to said member; and at least one front vertical wall having an upper end and a lower end and extending along said front portion, wherein said front vertical wall upper end is connected to said front concave panel.

2. The apparatus of claim 1, wherein said front and rear portions further include at least one pad.

3. The apparatus of claim 1, wherein said member further includes at least one longitudinal strengthening groove.

* * * * *